United States Patent [19]

Lobachev et al.

[11] 4,282,012

[45] Aug. 4, 1981

[54] COMPOSITION FOR THE MANUFACTURE OF ABRASIVE TOOLS

[76] Inventors: Viktor A. Lobachev, ulitsa Z. Kosmodemianskoi, 4, kv. 4, Khimki, Moskovskaya oblast; Vladimir G. Safronov, Kronshtadtsky bulvar, 43, korpus 3, kv. 283, Moscow; Faina B. Danilova, ulitsa B. Uchitelskaya, 10, kv. 10, poselok Vodniki, Moskovskaya oblast; Vladimir N. Lvov, ulitsa Obrucheva, 5, korpus 1, kv. 10, Moscow, all of U.S.S.R.

[21] Appl. No.: 9,743

[22] Filed: Feb. 5, 1979

[30] Foreign Application Priority Data

May 14, 1978 [SU] U.S.S.R. ..... 2608953

[51] Int. Cl.[3] ..... B24D 3/02

[52] U.S. Cl. ..... 51/309; 51/293

[58] Field of Search ..... 51/293, 309, 307

[56] References Cited

U.S. PATENT DOCUMENTS

| | | | |
|---|---|---|---|
| 633,489 | 9/1899 | Revalk | 51/307 |
| 1,903,346 | 4/1933 | Welsch | 51/309 |
| 3,097,083 | 7/1963 | Shelton | 51/309 |
| 4,022,625 | 5/1977 | Shelton | 51/309 |

*Primary Examiner*—Donald E. Czaja
*Assistant Examiner*—W. Thompson
*Attorney, Agent, or Firm*—Lackenbach, Lilling & Siegel

[57] ABSTRACT

The present invention relates to compositions for the manufacture of abrasive tools which can be most effectively used for the manufacture of tools employed for machining of articles made of sitals, hard alloys and other difficultly machinable materials. This composition contains, as a binding agent, compounds selected from the group of caustic alkalis in combination or separately, the composition components having the following proportions, percent by volume:

| | |
|---|---|
| abrasive powders | 12.5 to 37.5 |
| metal powders | 25.0 to 62.5 |
| caustic alkalis | 12.5 to 50.0 |

15 Claims, No Drawings

COMPOSITION FOR THE MANUFACTURE OF ABRASIVE TOOLS

The present invention relates to the manufacture of abrasive tools, in particular to a composition for the manufacture of working members of tools from diamond, cubic boron nitride and other superhard materials.

The present invention can be employed in factories manufacturing diamond and abrasive tools and as individual final tools for various industries, more specifically for processing of articles made sitals, hard alloys and other difficulty machinable materials.

Known in the art are a great number of compositions for the manufacture of abrasive tools which compositions contain abrasive and metal powders, and binders as well. However, the use of such tools for machining of sitals has certain disadvantages.

In experimental studies it has been found that in the machining of a sitals composition for diamond wheels those having a metal binding agent containing copper and tin are optimal (cf. USSR Inventor's Certificate No. 360214). This composition consists of copper, tin and ferric oxide. A specific consumption of diamond in these wheels for machining of sitals is 0.25 to 9.30 mg/g.

These wheels, however, possess an essential disadvantage in that during machining of a sital they form micro-cracks and spallation on the machined surface due to a high adhesion. Labor productivity in machining performed with such tools is not high.

Productivity of tools can be increased by improving their self-sharpening capability through the use of more sophisticated compositions for the manufacture of the tools. Examples of such compositions are those described in the USSR Inventor's Certificates Nos. 392135 and 402458 and containing: copper, aluminum, titanium, silicon, zinc, tin, boron nitride (USSR Inventor's Certificate No. 392135); copper, a metal fluoride and a metal selected from the group consisting of zinc, tin, cadmium, aluminum, silver (USSR Inventor's Certificate No. 402458). However, durability of such tools is substantially lower as compared to that of tools made of the composition containing copper and tin. Another disadvantage of tools manufactured from a multi-component composition resides in their impaired processibility (the necessity of a strict dosage and thorough homogenization). A common disadvantage of tools manufactured with the use of metal binding agents is the necessity of using high temperatures for their manufacture (650° to 700° C.) and considerable pressures (1.5 to 2 t/cm$^2$) which results in a rapid wear of rather expensive compression molds.

It is an object of the present invention to provide a composition for the manufacture of abrasive tools with a binding agent containing components which ensure highly efficient machining of a sital, hard alloy and other difficulty machinable materials while providing for high resistance of the tools.

These and other objects of the present invention are accomplished with a composition for the manufacture of abrasive tools containing metal and abrasive powders and a binding agent. In accordance with the present invention the binding agent contains compounds selected from the group consisting of caustic alkalis employed either individually or in combination, the components of the composition according to the present invention being in the following proportions, percent by volume:

| | |
|---|---|
| abrasive powders | 12.5 to 37.5 |
| metal powders | 25.0 to 62.5 |
| caustic alkalis | 12.5 to 50.0 |

The use of caustic alkalis (a mixture of alkalis or eutectic mixture of alkalis) makes it possible, in machining sitals and other difficulty machinable materials, to increase productivity of machining and to obtain a defect-free surface finish owing to a chemical effect exerted by alkalis on the material being processed. The use of an eutectic mixture of alkalis makes it possible to lower the compression-molding temperature of tool manufacture and, consequently, improve durability and increase the life time of compression molds.

Selection of the above-specified percentage amounts of the composition ingredients is based on the following considerations. Upon reducing the content of diamond powder below 12.5% there occurs a substantial decrease of cutting ability of the tools, while upon increasing said content above 37.5% the tool cost becomes unreasonably high. With decreasing content of the metal powder below 25% the tool durability is insufficient, while increasing the metal powder content above 62.5% results in an impaired ability of the tool with respect to self-sharpening. Incorporation of components belonging to the group of caustic alkalis in an amount of above 50% decreases the life time of the tools, while in amounts below 12.5% these components do not provide any positive effect.

The manufacture of tools is performed in the following manner: the above-mentioned components are weighed and then used for the preparation of a diamond-containing charge. In weighing alkalis conventional safety measures should be taken (rubber gloves, respiration means, dry working premises). The components are charged into a closed vessel for intermixing. After mixing the resulting mass is charged into a compression mold and compressed under a specific pressure of 800–1,000 kg/cm$^2$ at a temperature corresponding to the melting temperature of the alkali component (see Table). On subsequent cooling a highly-durable article is obtained.

Prior to compression-molding, the working cavity of the mold and all movable joints thereof should be coated with a graphite lubricant.

It follows from the Examples given in the Table hereinbelow that incorporation, into the composition containing abrasive and metal powders, components selected from the group of caustic alkalis makes it possible to achieve high machining efficiency at small specific consumption of abrasives (diamonds). It is also possible to reduce temperature of compression in the manufacture of tools which ensures higher durability of molds. No etching effect on molds has been observed on the part of said alkali components, provided that all requirements for the manufacture of tools are fulfilled: dry working premises, application of a graphite lubricant, and the like.

TABLE

| Examples illustrating embodiments of the present invention | | | | | | | | |
|---|---|---|---|---|---|---|---|---|
| Components of the composition vol. % | Compression-molding conditions | | Hardness of tools, HRB units | Electrical conductivity of tools m/ohm . mm² | Test results | | | |
| | Temperature, °C. | Pressure, kg/cm² | | | Machined material | Capacity, g/min | Specific consumption of diamonds, mg/g | Grinding type |
| 1 | 2 | 3 | 4 | 5 | 6 | 7 | 8 | 9 |
| Diamond 25 | 330–350 | 800–1000 | 103 | 5.5 | Metal-ceramic hard alloy | 2.8 | 0.15 | Electrochemical |
| Copper 50 Alkali 25 | | | | | Sital | 2.0 | 0.10 | Conventional |
| Diamond 25 Copper 62.5 | 280–300.C | 800–1000 | 98 | 4.9 | Metal-ceramic hard alloy | 2.6 | 0.13 | Electrochemical |
| Eutectic of alkalis NaOH—KOH 0.42:0.58 respectively | | | | | | | | |
| *1 | 2 | 3 | 4 | 5 | 6 | 7 | 8 | 9 |
| Diamond 25 Copper 25 | | | | 1.3 | Metal-ceramic hard alloy | 2.0 | 0.4 | Conventional |
| Mixture of NaOH & KOH 50 0.42:0.58 respectively | 300–330 | 800–1000 | 100 | | | | | |
| Diamond 12.5 Iron 57.5 Alkali KOH 30 | 450–550 | 1000–1200 | 105 | — | Marble | — | — | Conventional |
| Diamond 20 Silicon carbide 17.5 | 330–350 | 800–1000 | 105 | 2.6 | Metal-ceramic hard alloy in combination with steel | 2.0 | 0.5 | Electrochemical |
| Powder of copper-tin alloy 50 | | | | | Metal-ceramic hard alloy | 3.2 | 0.4 | Conventional |
| NaOH alkali 12.5 | | | | | Sital | 2.4 | 0.15 | Conventional |

What is claimed is:

1. In a composition for the manufacture of abrasive tools consisting essentially of abrasive powders, metal powders and a binding agent, wherein the improvement comprises, the binding agent is a solid caustic alkali selected from the group consisting of potassium hydroxide and sodium hydroxide separately or in combination, the components being present in the following proportions, in percent by volume:

| | |
|---|---|
| abrasive powders | 12.5 to 37.5 |
| metal powders | 25.0 to 62.5 |
| caustic alkali[s] | 12.5 to 50.0. |

2. The composition of claim 1, wherein the caustic alkalis are a eutectic mixture.

3. The composition of any of claims 1 or 2, wherein the caustic alkali is a mixture of sodium and potassium hydroxide.

4. The composition of claim 1, wherein said abrasive powder is selected from the group consisting of diamond, silicon carbide, boron nitride, and mixtures thereof.

5. The composition of claim 1, wherein the metal powders are selected from the group consisting of copper, tin, iron, aluminum, titanium, zinc, cadmium, silver, and mixtures thereof.

6. The composition of claim 1, wherein the metal powders are selected from the group consisting of copper, tin, and mixtures thereof.

7. The composition of claim 1, wherein said abrasive powder is diamond.

8. In a method for manufacturing an abrasive tool consisting essentially of abrasive powders, metal powders and a binding agent as components, the improvement wherein the binding agent is a solid caustic alkali selected from the group consisting of potassium hydroxide and sodium hydroxide, alone or in combination, and said components are mixed in the following proportions, in percent by volume:

| | |
|---|---|
| abrasive powders | 12.5 to 37.5 |
| metal powders | 25.0 to 62.5 |
| caustic alkali | 12.5 to 50.0; |

charging the mixed components into a compression mold and compressing said mold at sufficient pressure and temperature to melt the caustic alkali component.

9. The method of claim 8, wherein said pressure varies from 800–1200 kg/cm² and said temperature varies from 280°–550° C.

10. The method of claim 8, wherein the caustic alkalis are a eutectic mixture.

11. The method of any of claims 8 or 10, wherein the caustic alkali is a mixture of sodium and potassium hydroxide.

12. The method of claim 8, wherein the abrasive powders are selected from the group consisting of diamond, silicon carbide, boron nitride and mixtures thereof.

13. The method of claim 8, wherein the metal powders are selected from the group consisting of copper, tin, iron, aluminum, titanium, zinc, cadmium, silver, and mixtures thereof.

14. The method of claim 8, wherein the metal powders are selected from the group consisting of copper, tin, and mixtures thereof.

15. The method of claim 8, wherein said abrasive powder is diamond.

* * * * *